US006315608B1

(12) United States Patent
Lopata et al.

(10) Patent No.: US 6,315,608 B1
(45) Date of Patent: Nov. 13, 2001

(54) CHANNEL ISOLATION SHIELD

(75) Inventors: John E. Lopata; Yew Teck Yap; David L. Brunker, all of Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/540,606

(22) Filed: Mar. 31, 2000

(51) Int. Cl.[7] ..... H01R 13/648
(52) U.S. Cl. ..... 439/607
(58) Field of Search ..... 439/607, 608, 439/609, 610, 677, 680, 681

(56) References Cited

U.S. PATENT DOCUMENTS

| | | | | |
|---|---|---|---|---|
| 4,353,108 | | 10/1982 | Chippel | 361/386 |
| 4,571,012 | * | 2/1986 | Bassler et al. | 439/101 |
| 4,678,260 | | 7/1987 | Gallusser et al. | 439/607 |
| 4,841,102 | | 6/1989 | Elsner et al. | 174/35 |
| 4,981,447 | | 1/1991 | Ichitsubo | 439/607 |
| 4,990,094 | * | 2/1991 | Chandler et al. | 439/108 |
| 4,995,819 | | 2/1991 | Ohl | 439/79 |
| 5,087,210 | | 2/1992 | Myers et al. | 439/425 |
| 5,207,597 | * | 5/1993 | Kline et al. | 439/607 |
| 5,232,380 | | 8/1993 | Inoue et al. | 439/610 |
| 5,326,281 | | 7/1994 | Yin | 439/607 |
| 5,685,739 | * | 11/1997 | Davis et al. | 439/607 |
| 5,938,473 | | 8/1999 | Nishio et al. | 439/567 |
| 5,944,559 | | 8/1999 | Wu | 439/607 |
| 6,168,467 | * | 1/2001 | Chiou | 439/607 |

* cited by examiner

*Primary Examiner*—Brian Sircus
*Assistant Examiner*—Thanh-Tam Le
(74) *Attorney, Agent, or Firm*—Robert J. Zeitler; Thomas D. Paulius

(57) ABSTRACT

A shielded connector has an outer metal shield that is formed from a metal shell. One or both free ends of the shell are upturned and abutted together so as to form an inner shielding wall. This inner shielding wall extends into the receptacle portion of the connector between pairs of designated terminals. The connector housing is molded over the free ends in order to hold them together. The inner shield wall increases capacitive coupling with the connector terminals which decreases the impedance of the connector.

37 Claims, 8 Drawing Sheets

CHANNEL ISOLATION SHIELD

BACKGROUND OF THE INVENTION

The present invention relates generally to high speed connectors, and more particularly to a connector for terminating a cable having multiple distinct signal channels, each channel including at least a pair of differential signal wires and terminals.

Many shielded connectors are known in the art, in which an insulative connector housing is provided to support a plurality of conductive terminals. The housing may have a metal ground shield to provide additional grounding for the connector and for signal isolation. Notwithstanding the presence of the exterior shield, a separate ground pin is often provided in the connector housing. The external metal shield may use either crimping or a butt contact to hold it together. Such a shield structure is not mechanically robust. This type of shield member also uses interlocking members stamped at the ends of the shield member. The use of these members at that location reduces the ability to use the ends of the shield for shielding purposes.

In multiple-channel connectors, the signal terminals of each channel are typically arranged together in side-by-side order along a mating surface of the connector. These signal terminals are not isolated from each other, which may lead to crosstalk occurring between the signal channel wires, thereby hampering the electrical performance of the connector.

Historically, in multiple-channel connectors, the outermost signal terminals have had a particular electrical relationship to the outer metal shield both to the bottom wall and the vertical sidewalls of the shield. These outermost conductive terminals have a greater electrical affinity to the shield than do the innermost conductive terminals because the innermost terminals are spaced relatively far away from the vertical sidewalls of the shield and have no vertical shield wall close to them. Consequently, the innermost terminals display an electrical affinity for each other rather than to the shield, thereby resulting in crosstalk between them which may lead to potentially degrading interference of signal transmission through the terminals, especially in high speed electrical transmission lines. The electrical relationship between the signal terminals and the outer shield of the connector is therefore potentially unbalanced in these known shielded connectors.

The present invention is directed to a shielded, multichannel connector having a balanced electrical field relationship between its signal terminals and the shield of the connector.

SUMMARY OF THE INVENTION

It is therefore a general object of the present invention to provide a multiple-channel connector in which the electrical field relationship between the signal terminals of the connector and the outer shield is balanced.

Another object of the present invention is to provide a shielded connector having at least two different signal channels that are electrically isolated from each other by a portion of the outer shield of the connector that extends into the connector housing.

Yet another object of the present invention is to provide a connector particularly suitable for use in multi-channel high speed electrical signal transmission applications, wherein a consistent distance between innermost and outermost signal terminals and an external ground shield is maintained so as to provide a substantially uniform capacitance between these signal terminals and the ground shield.

A further object of the present invention is to provide a shielded connector housing at least two pairs of differential signal terminals, in which a metal grounding shield applied to an exterior surface of the connector, the shield encircling the connector housing and extending between the pairs of differential signal terminals to thereby define a central, signal isolation barrier interposed between the differential signal terminals to provide electrical isolation between the two pairs of differential signal terminals.

A still further object of the present invention is to provide a shielded connector as previously mentioned wherein the signal isolation barrier formed by the shield is substantially encased within part of the connector housing to reduce the required distance between associated pairs of signal terminals.

Yet another object of the present invention is to provide an improved shielded, receptacle connector for mating to a plug connector, the connector having an insulative housing with a receptacle portion that supports at least two distinct pairs of differential signal terminals and a metal shield that extends around the exterior of the housing to encircle the receptacle portion of the connector, the shield being bent around the housing and having two free ends that are aligned with each other in an abutting relationship, the shield free ends rising from the exterior of the connector housing and entering the receptacle portion thereof to thereby define an additional, inner shield wall that extends within the receptacle portion, the shield free ends being encased in the housing and forming part of a key for aligning the opposing plug connector with the receptacle connector.

These and other objects are accomplished through the unique and novel structure of the invention. In one principal aspect of the present invention, and as exemplified by one embodiment thereof, a shielded connector is provided for circuit board applications. The connector includes pairs of conductive signal terminals supported widthwise along an interior face of an insulative connector housing. A metal shield is positioned on the exterior of the connector housing to form a hollow shell in which the connector housing and its associated signal terminals sit. This shield includes signal channel isolation means that serve to better electrically isolate the signal channels from each other and reduce interference between the signal channels.

These signal isolation means include a modification of the shield member to form an internal shield member that extends into the receptacle part of the connector in which the signal terminals sit. This internal shield wall is positioned between the two signal channels, preferably along the center line of the connector so that both signal terminals of each signal terminal pair are positioned equidistant from both the bottom wall of the shield member and a sidewall of the shield member that is in proximity to the signal terminals.

In another principal aspect of the present invention, the external shield member is folded or crimped so that it forms at least one inner shield wall that extends into the receptacle of the connector to thereby define at least one pair of internal shield "corners" in the connector. The inner shield wall of the invention may include a single thickness of the shield member or a double thickness thereof. The inner shield walls may abut each other in this extent into the connector receptacle, or they may be interweaved with each other, or they may be separated by a predetermined distance and filled with connector housing material.

In another principal aspect of the present invention, the inner shield wall may be encased in the same material of which the connector housing is made so that the inner wall may be incorporated into a key of the connector housing. This also reduces the distance between the signal channels in that it utilizes an existing key already accommodated by the connector.

In another principal aspect of the present invention, the connector housing may be molded directly within the formed shield member and ends of the inner wall may be formed and positioned to provide support to mold detail tooling inserted into the shield that will define the receptacle of the connector.

These and other objects, features and advantages of the present invention will be clearly understood through consideration of the following detailed description

BRIEF DESCRIPTION OF THE DRAWINGS

In the course of the following detailed description reference will be frequently made to the accompanying drawings in which.

DETAILED DESCRIPTION OF THE PREFERRED EMBODIMENTS

Figure 10:
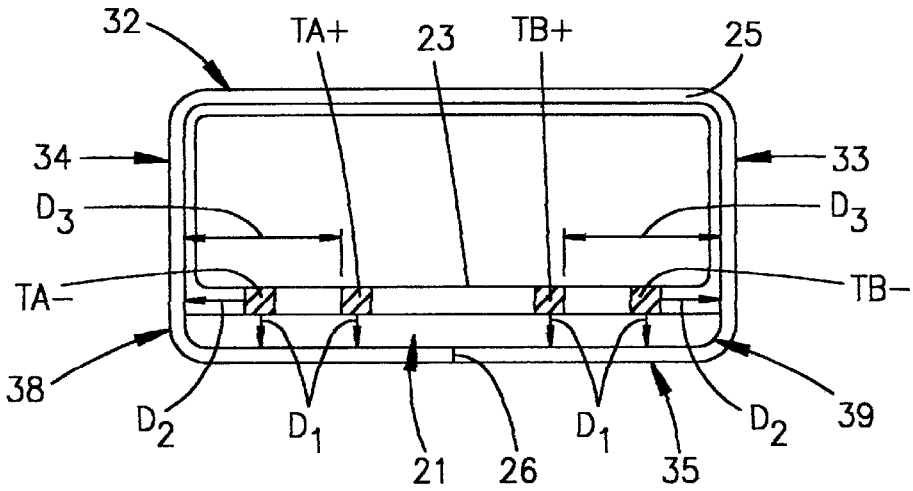
FIG. 10 (PRIOR ART)
FIG. 10 is a schematic representation of a prior art shielded connector.

FIG. 10 illustrates schematically, a known shielded connector having a construction that is typical of the prior art. The connector 20 has an insulative housing 21 with four conductive signal terminals 22 being arranged along a lower inner face 23 of the housing 21. A metal shell or shield 25 is applied around the exterior of the housing 21 to encircle the housing 21. This shield 25 is typically formed with one piece of metal and folded around the connector housing 21 so that its free ends 26 meet together in an abutting, or edge-to-edge relationship.

Typically, the terminals 22 are arranged in differential signal pairs, such as TA− and TA+ being one such pair and TB− and TB+ being the other pair. All of these terminals 22 are spaced about the same distance $D_1$ from the bottom walls 35 of the shield 25. However, the terminals of each channel are spaced different distances from the other walls of the shield 25. For example, the outermost terminals TA−, TB− are spaced about an equal distance $D_2$ from the respective sidewalls 33, 34 of the shield 25, but the innermost terminals TA+, TB+ are spaced a different distance $D_3$ from the shield sidewalls 33, 34. This distance $D_3$ is larger than the distance that separates these two terminals so that the signal terminals forming channel A, TA+ and TA− are not electrically isolated from the terminals forming channel B of the connector, namely TB+ and TB−. The outermost signal terminals TA− and TB− will have a greater electrical affinity to the shield walls 33, 34 that adjoin it than will the innermost signal terminals, TB+, TA+.

This electrical affinity involves at least two physical aspects: the spacing of the terminals from each other and a ground and the plate size of the nearest ground or terminal. Where three terminals are spaced from each other different distances, the first terminal that is spaced closer to the second terminal rather than the third terminal, will exhibit an electrical affinity to the second terminal, rather than the third terminal. Likewise, if the three terminals are spaced equally apart but the third terminal has a larger plate size than the first terminal, the second terminal will exhibit a greater electrical affinity to the third terminal rather than the first terminal.

In the prior art construction illustrated in FIG. 10, it can be seen that the shield member 25 defines two exterior "corners" 38, 39 of the shield 25. The term "exterior" is chosen because these corners 38, 39 are formed on the exterior surface of the connector housing, rather than within the connector housing. These two corners 38, 39 can be considered as having two ground plates that extend in two different planes: as shown in FIG. 10, the exterior corners consist of sidewalls 33, 34 and the bottom shield wall 35. The outermost terminals of the connector TA− and TB− sit close to these corners and thus capacitive coupling will occur between these outermost terminals TA− and TB− and the grounding shield walls 33, 34 and 35. However, the two innermost terminals TA+ and TB+ have no such corners or additional grounding plates with which to couple. Thus the impedance for these innermost terminals is likely to be higher than that of the outermost terminals, thereby creating an electrically unbalanced system.

The present invention solves this problem and provides electrical isolation between multiple signal channels and which balance the electrical fields generated by the signal terminals. It also increases capacitive coupling for the innermost signal terminals which in turn leads to a decrease in impedance. This is accomplished by incorporating a signal channel isolation means into the connector. Whereas the embodiments shown in the figures illustrate the signal channel isolation means on a receptacle connector, it is not so limited and may also be incorporated into a plug connector.

Figure 1:
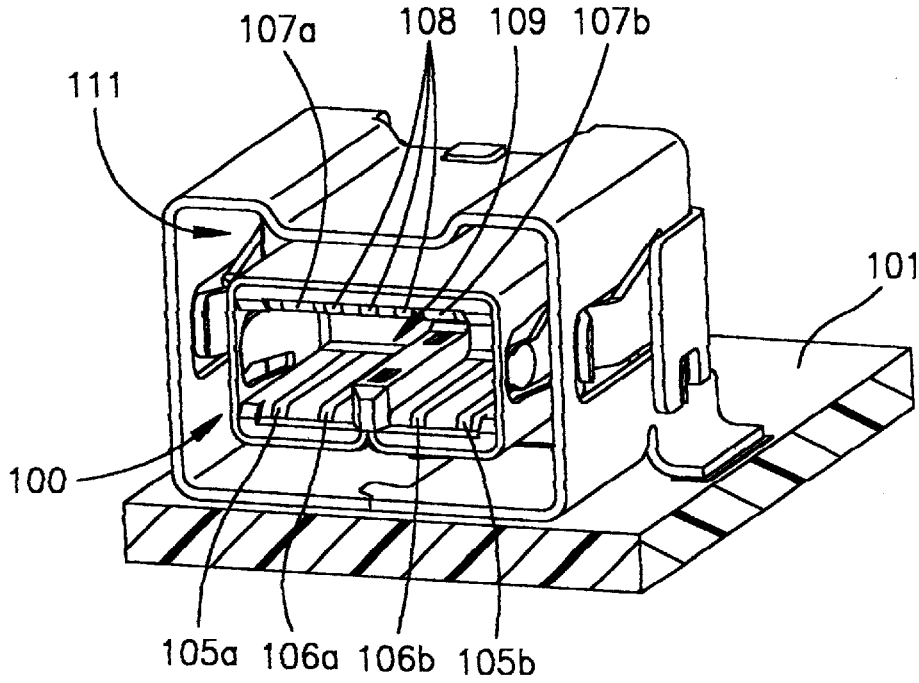
FIG. 1 is a perspective view of a board connector incorporating signal channel isolation means constructed in accordance with the principles of the present invention.

FIG. 1 illustrates a connector 100 constructed in accordance with the principles of the present invention. The connector 100 is shown as a board connector for mounting to a circuit board 101. The connector 100 includes an insulative housing 102 that is held within a metal shield 104. The housing supports a plurality of conductive terminals and the terminals preferably are differential signal terminals, associated ground terminals and other terminals. The signal terminals are arranged so that they will accommodate two channels of signal data, meaning that a pair of terminals 105*a*, 106*a* serve as the differential signal terminals that carry positive and negative voltages for one channel of a transmission cable, while the other pair of terminals 105*b*, 106*b* carry positive and negative voltages for another channel of a transmission cable. Each such differential signal channel dependent on the application in which the connector is used, may have a conductive ground terminal 107*a*, 107*b* associated therewith.

Figure 5:
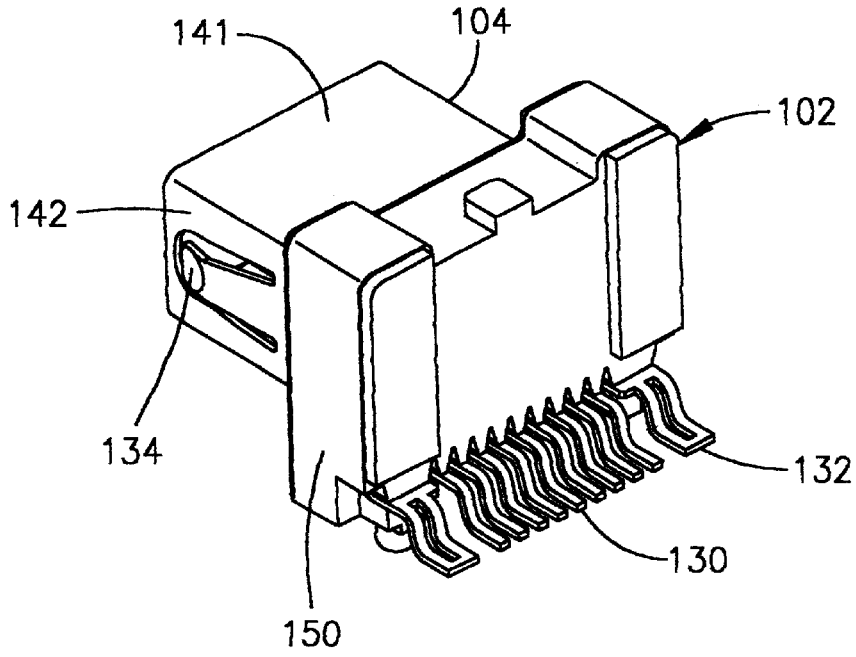
FIG. 5 is a perspective view taken from the rear end of the receptacle connector portion of the board connector of FIG. 1, illustrating the rear end face of the connector, the terminal mounting portions and the connector board engagement posts.
Figure 6:
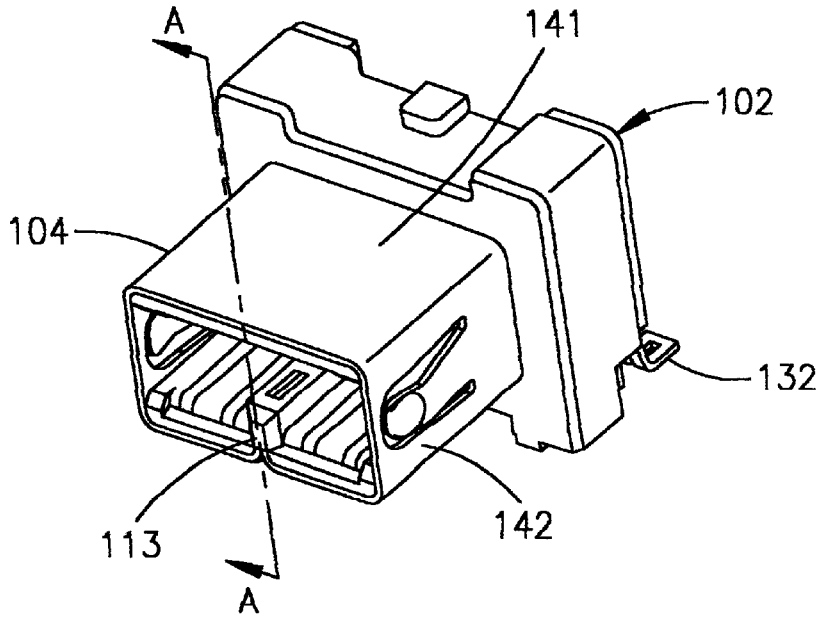
FIG. 6 is a frontal perspective view of the receptacle connector of FIG. 5.

Turning briefly to FIGS. 5 and 6, the connector housing 102 has a rear body portion 150 by which the connector 100 may be supported on a circuit board. A pair of ledges, or walls 120, 122 extend out from the rear body portion 150 in a cantilevered position as shown best in FIGS. 3 and 7. These two walls 120, 122 may be joined together by sidewalls 123 (FIG. 16) so that all such walls cooperatively define a receptacle, or cavity 109 of the connector housing 102.

A portion of the connector housing 102, preferably that portion that includes any of the previously mentioned walls 120, 122 and 123, is surrounded, or encircled by the shield member 104 to form a shielded connector assembly and this combined assembly may be positioned within a further outer shield 110 in the form of a shell that is mounted to the circuit board 101. This outer, further shield member 110 cooperates with the connector shield member 104 to define a hollow cavity 111 that receives part of an opposing connector, such as the plug connector 200 illustrated in FIG. 2.

Figure 2:
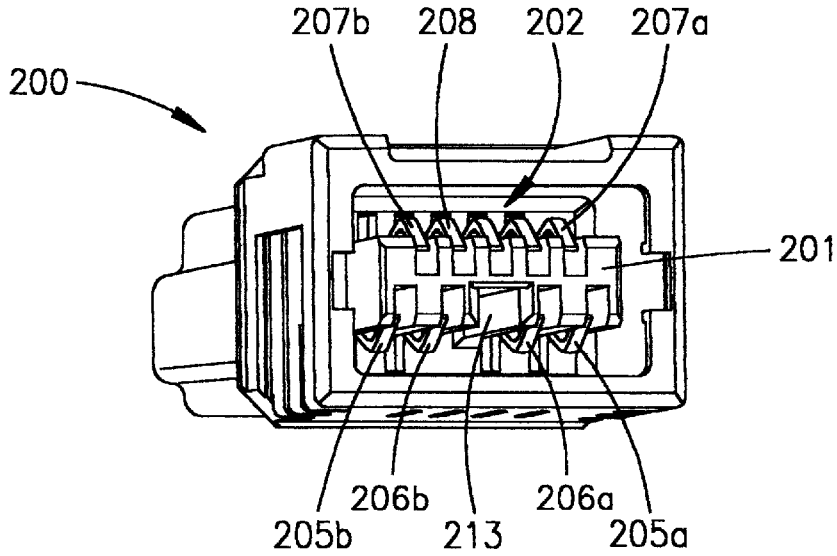
FIG. 2 is a perspective view of a plug connector that may be terminated to a cable and engaged with the connector of FIG. 1.

FIG. 2 illustrates a plug connector 200 that typically will be terminated to a transmission line, such as a cable, at the rear face thereof which is not illustrated in FIG. 2. The connector 200 takes the form of a plug connector and as such, may include a center leaf portion 201 formed as part of the overall connector housing 202. This connector includes conductive terminals that correspond in number and function to the terminals of the connector 100. In this regard, the connector 200 includes pairs of signal terminals 205*a*, 205*b* and 206*a*, 206*b* arranged along the lower face of the leaf portion 201, as shown. The signal terminals 205*a*, 206*a* are preferably terminated to differential signal wires of one channel of a cable (not shown) while the signal terminals 205*b*, 206*b* are also preferably terminated to differential signal wires of another channel of the cable. Hence, the suffix "a" or "b" to the reference numerals used in this description will refer elements associated with the respective "A" or "B" channels of the connector system.

The signal terminals 205*b*, 206*b* shown in the left in FIG. 2 correspond to and will mate with the signal terminals 105*b*, 106*b* of the receptacle connector 100 shown to the right of FIG. 1. Likewise, the signal terminals 205*a*, 206*a* shown in the right of FIG. 2 correspond and mate with the signal terminals 105*a*, 106*a* shown to the left in FIG. 1. The plug connector 200 also includes ground terminals 207*a*, 207*b* that correspond to and respectively mate with the ground terminals 107*a*, 107*b* of the receptacle connector 100. The remaining terminals 208 correspond to and mate with opposing terminals 108 of the receptacle connector 100. These other terminals may be used to carry power in and out of the system as well as for other related purposes.

Figure 3:
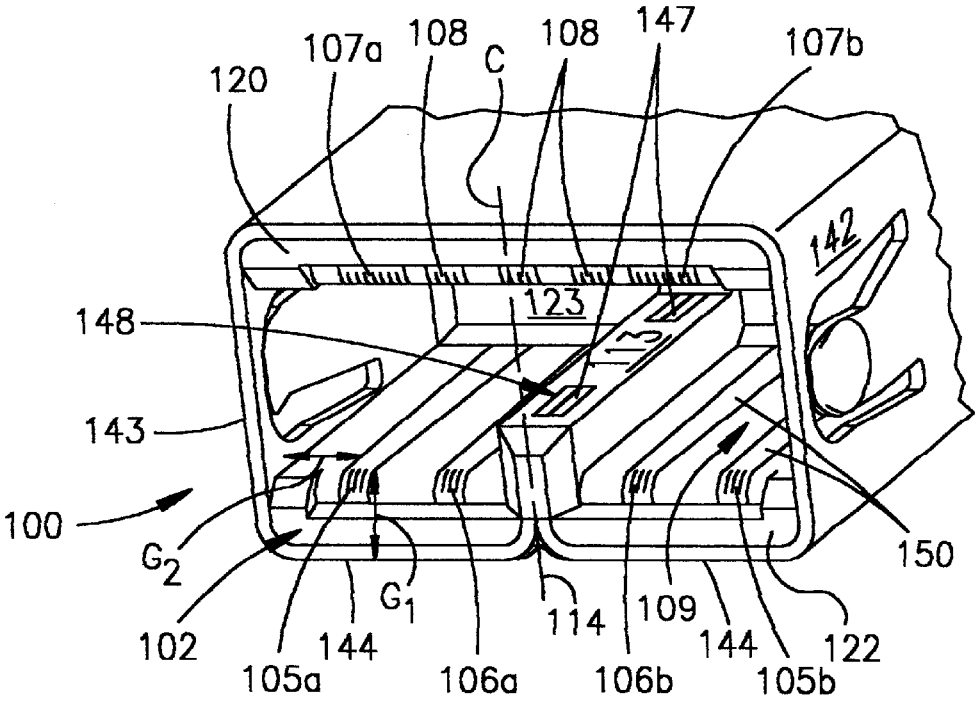
FIG. 3 is an enlarged detail view of the receptacle portion of the connector of FIG. 1.

Turning now to FIG. 3, the details of the interior receptacle 109 of the connector 100 are shown more clearly. It can be seen that the connector housing 102 fills part of the interior space defined by the shield member 104. The housing 102 may include, as illustrated, a top ledge, or wall 120, and a bottom ledge, or extent 122. These two walls 120, 122 are preferably joined together to the rear body portion 150 of the housing 102 and each such extent supports a plurality of terminals as illustrated. In order to provide polarizing and alignment capabilities to the connector, the housing 102 may include a central key 113 illustrated as an upstanding wall or lug 114 that preferably extends for the entire depth of the connector interior receptacle 109. This key 113 is received within a corresponding keyway, or slot 213 formed in the plug connector 200 of FIG. 2, and these two elements serve to align and polarize the two connectors 100, 200 to prevent the inadvertent misconnection thereof.

Figure 4:
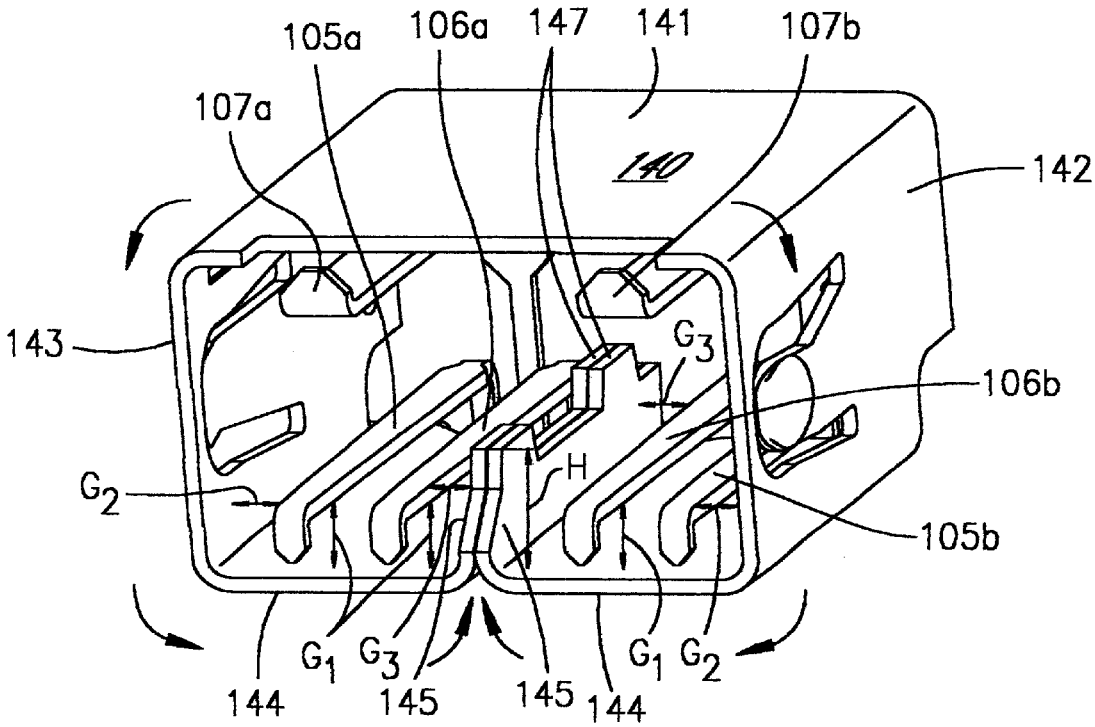
FIG. 4 is a perspective view of a shield member with signal channel isolation means and with two channels of signal and ground terminals positioned in place within the shield member cavity.

FIG. 4 illustrates the connector shield member 104 with only the signal terminals 105*a*, 106*a*, 105*b*, 106*b* and ground terminals 107*a*, 107*b* in place therein. This figure. illustrates how the connector 100 will appear prior to the connector housing 102 being molded in place in the shield member 104. As can be generally seen in FIG. 4, the shield member 104 may be formed from a single piece of metal 140. This piece is formed around itself in the direction of the arrows shown in FIG. 4 to define a plurality of shield walls. These walls include a top wall 141, left and right sidewalls 142, 143, two bottom walls 144 and two abutting inner walls 145. Whereas in the prior art, a shield was formed by forming the shield in a similar manner until the edges of their free ends met in an edge-to-edge relationship along the exterior surface of one of the connector housing walls, in the present invention the metal blank 140 is formed so that the free ends 146 of the blank are mated together in a side-by-side abutting relationship, as illustrated.

This is important because of the extent, or height H, to which these inner walls 145 extend. These shield free ends 146 extend upwardly in the orientation shown in the figures, but importantly extend into the connector receptacle 109, or at least toward it. By extending in this direction, the interior "corners" are now formed in proximity to the innermost signal terminals 106*a*, 106*b*. Such inner corners, the innermost terminals 106*a*, 106*b* of the connector will now have the grounding shield extend as a plate in two different planes, similar as with the exterior corners but now within the connector housing itself. This height H may extend from that shown in FIG. 16, of about even with the bottom "X" of the terminals 105*a*, 105*b*, 106*a* and 106*b* to the bottom surface of the top wall 141 of the shield as shown in phantom in FIG. 12. It is also believed that the height H may have its lowest magnitude of about 50% of thickness of the connector housing lower wall 122 from between the bottom of the signal terminals to the bottom shield wall 144.

With these heights, a beneficial electrical function of the shield inner walls is established with the innermost signal terminals. It should be noted that although the shield inner walls 145 are shown disposed on the lower face of the receptacle connector between the signal terminals thereof, their position is dependent on the location of the signal terminals. Thus, if the signal and ground terminals of the connector 100 were inverted from their location shown, i.e., the signal terminals were located on the upper face of the receptacle connector, the shield inner walls would be located at the top part of the connector.

With the shield member 40 having an inner wall 145, the capacitive coupling between the innermost signal terminals 106*a*, 106*b* and the inner shield wall 145 will be increased. This is in part due to the formation of an additional, but vertical ground plate, i.e. the free ends 146. This additional coupling for the innermost terminals will result in a drop of the common mode impedance of those terminals to the inner shield wall 145. It also enhances the isolation between the innermost terminals in that their electrical affinity will now be directed toward the inner shield wall 145 rather than each other. This results in a more balanced electrical system. The increase in coupling caused by the inner shield wall 145 will lower the common mode impedance of the innermost terminals 106*a*, 106*b* and drive their common mode impedance lower and closer to the common mode impedance of the outermost terminals 105*a*, 105*b*. This vertical, inner shield wall 145 that is folded and elevated with respect to the signal terminals will provide an effective conductive isolation barrier between the signal terminals 105*a*, 106*a* that form channel A of the system and the signal terminals 105*b*, 106*b* that form channel B of the system.

This may be partly understood with respect to the distances that are now present between the signal terminals 105*a*, 105*b* and 106*a*, 106*b* and the shield member 104. In the prior art connector of FIG. 10, there is an electric field associated with each signal terminal. The strength and intensity of this field depends on the presence of a grounding shield and its proximity of the shield to such a terminal. In the prior art, the fields generated by the innermost signal terminals have had no vertical shield to provide it with any such electrical affinity, and hence these fields are likely to contact and interfere with each other. This creates cross talk and other forms of interference.

The outermost signal terminals 105*a*, 105*b* may be considered as residing in a "corner" of the connector that is defined by the bottom shield walls 144 and the vertical shield sidewalls 142, 143, where the outermost terminals are spaced at approximately equal distances, as represented by $G_2$, (FIG. 4) from the vertical shield sidewalls 142,143 and the shield bottom walls 144. This close presence of the two shield walls forms a corner in which the signal terminals 105*a*, 105*b* extend. Thus, these two shield walls affect the electrical field developed along the these terminals.

Figure 14:
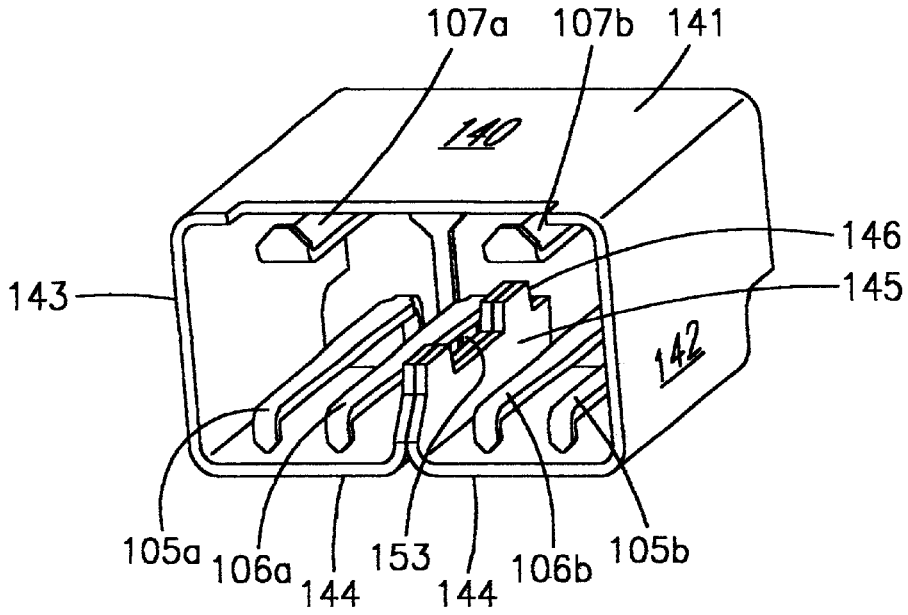
FIG. 14 is a perspective view of another embodiment of a grounding shield-terminal assembly of the invention wherein the inner shield wall does not continuously extend for the entire depth of the connector receptacle.

In the present invention, the distances $G_3$ between each of the innermost terminals 106*a*, 106*b* and the inner shield wall 145 are preferably the same. They may also, in some instances, be equal to or closely approximate $G_2$, which is the distance between the outermost terminals 105*a*, 105*b* and the sidewalls 142, 143 of the shield member 104 in order to obtain a desired capacitance in the system. This distance relationship may be changed depending upon the dielectric constant of the connector housing material and whether any air gaps are present between the terminals and the shield. These distances are preferably chosen so that although the physical distances $G_1$, $G_2$ and $G_3$ may not be the same, the capacitance of the system components is maintained at or near a desired level so that the same and a more consistent electrical performance is obtained. The innermost signal terminals 106*a*, 106*b* will now exhibit an electrical affinity for the inner shield wall 145 and the bottom walls 144 of the shield member 104, rather than just for each other and the bottom walls 144 of the shield member as in the prior art. Thus, with the entry of the inner shield wall 145 into the connector receptacle portion of the connector, a pair of interior "corners" are established for the innermost signal terminals, and in some instances at similar distances as are present in the aforementioned exterior "corners". In order to maintain this symmetry, it is desirable to maintain the interface between the two walls 145 at a datum line, which preferably coincides with the centerline C of the connector 100 (FIG. 3). This inner shield wall 145 may extend, as shown best in FIG. 12 along the entire depth of the connector receptacle 109. Or, as shown in FIG. 14, it may extend only partially within the receptacle 109, wherein a gap 153 is formed along the length, or depth, of this inner shield wall 145.

Figure 7:
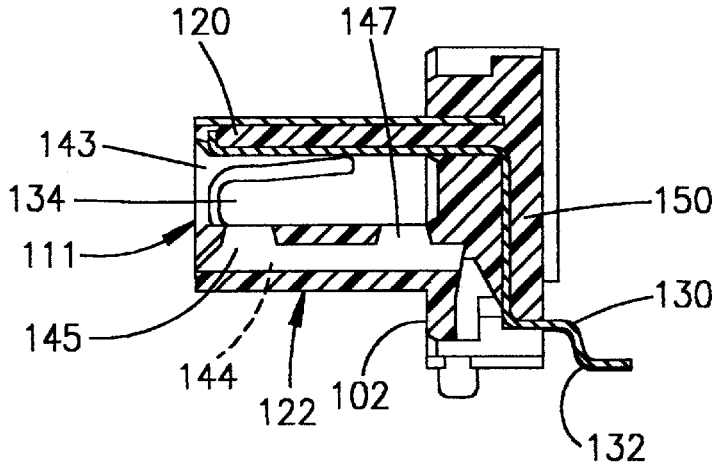
FIG. 7 is a cross-sectional view of the receptacle connector of FIG. 6 taken along lines A—A of FIG. 6.

The use of this inner shielding wall provides other benefits. For example, it eliminates the need for mechanically fastening the shield free ends, i.e., the inner walls 145 together within the shield member 104 itself, for during the molding of the connector housing, the plastic or other insulative material from which the housing 102 and its key 113 are formed serve to hold and lock the shield two free ends 146 together. As shown in FIGS. 3 and 7, it can be seen that the housing material effectively "encapsulates" the shield inner walls 145. In the molding of the connector housing 102, the sidewalls 123 of the connector housing may be formed, or as shown in FIG. 3, the connector receptacle 109 portion of the housing 102 may be formed without such sidewalls. The inner walls 145 may be provided with bearing edges 147 that cooperatively define one or more bearing surfaces 148 that are provided to contact mold detail tooling in order to support the shield member 104 during the over holding process.

Additionally, because such a connector 100 typically includes an alignment or polarizing key, the inner shield walls 145 of the present invention are encapsulated or captured within these keys and thus it may be used in connectors with dense terminal contact geometries without increasing the signal terminal spacing. The vertical, inner wall of the present invention also effectively replaces the conventional ground guard pin that was applied to the shield in prior art structure. The integrally folded inner shield structure of the present invention provides an equivalent to this ground guard pin, and positions it between the terminals making up the A and B channels of the connector.

Because of the large size of the inner walls 145 relative to the innermost terminals 106*a*, 106*b*, the inner shield wall of the present invention provides a large, conductive face interposed between the signal terminals of the two different channels of the connector. This large conductive face can conduct AC current by means of capacitive coupling. A symmetric mechanical relationship is imposed on the connector as well as a symmetrical electrical field relationship.

FIG. 5 illustrates the connector 100 of FIG. 3 from the rear, without its board shield 110. The housing 102 of the connector 100 can be clearly seen and the tail portions 130 of the various connector terminals can be seen protruding from the housing 102. Two grounding tabs 132 are illustrated as extending from the rear of the shield at the rear of the connector housing 102 for connecting the shield member 104 to a specific circuit(s) on the circuit board 101.

FIG. 7 is a cross-sectional view of the receptacle connector of FIG. 6 taken along the center line, or along line A—A thereof. This Figure illustrates how the metal shield inner walls 145 are encapsulated with the insulation housing material and their extent with respect to the depth of the connector receptacle 109.

Figure 8:
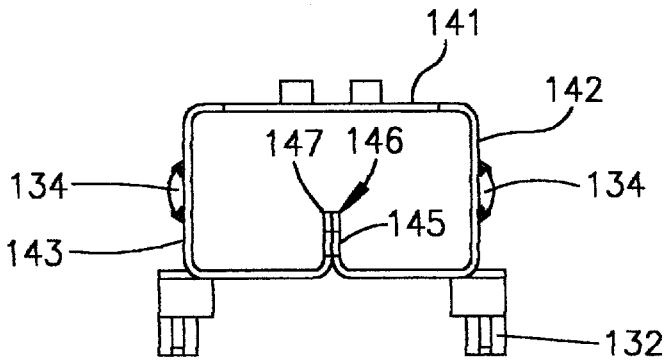
FIG. 8 is a front elevational view of the receptacle connector shield.
Figure 9:
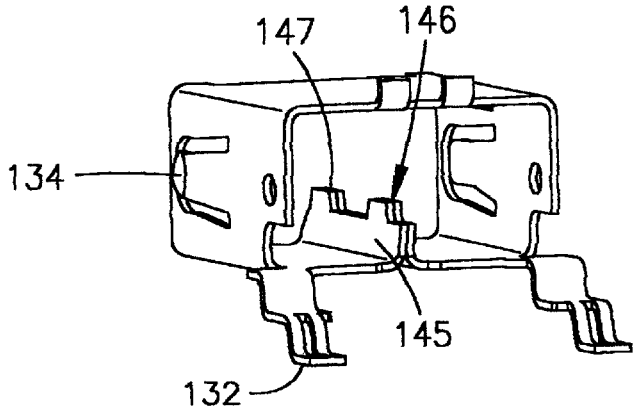
FIG. 9 is an angled perspective view of the receptacle connector shield from the rear of the shield.

FIGS. 8 and 9 illustrate other aspects of the shield member 104 and best depict how the shield ground tabs 132 are formed as part of the shield member 104. These tabs 132 will project from the connector housing 102 near the rear portion thereof. Additional means to ensure effective molding such as tabs 133 may be provided along the rear face of the shield. These tabs 133 may be embedded in the housing material. Inner engagement arms 134 may also be stamped and formed as part of the shield to assist in engaging the plug connector.

Figure 12:
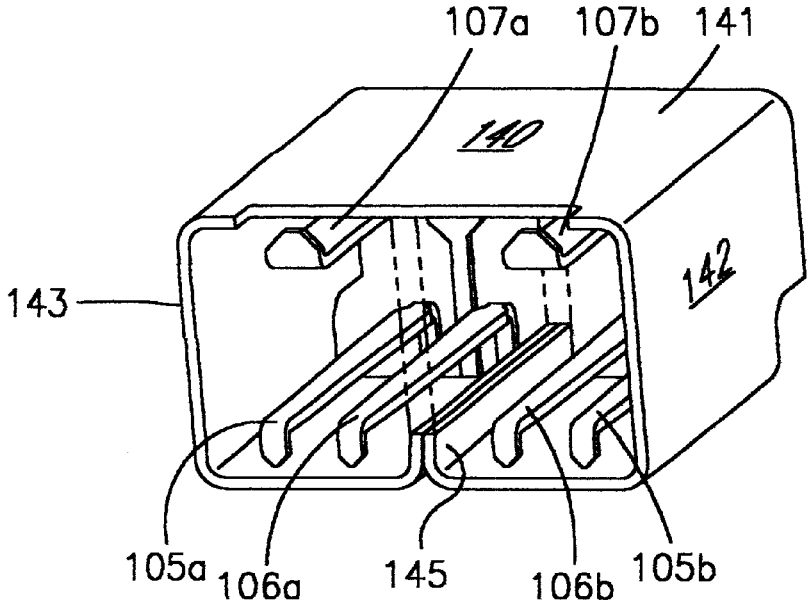
FIG. 12 is a perspective view of an alternate embodiment of a grounding shield-terminal assembly in accordance with the principles of the present invention, and illustrating an inner shield wall that extends the full depth of the connector receptacle.
Figure 13:
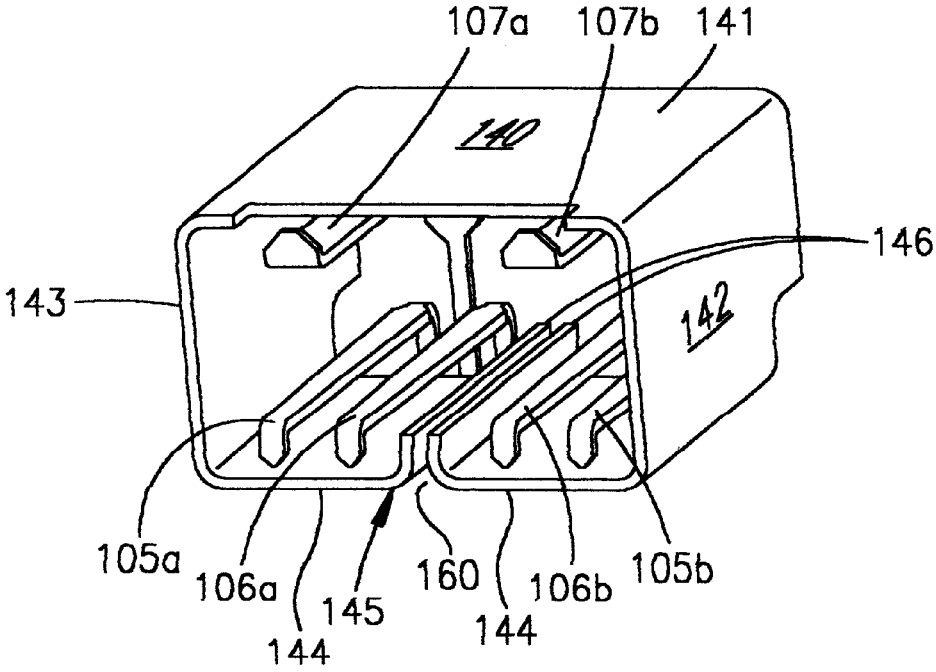
FIG. 13 is a perspective view of another embodiment of a grounding shield-terminal assembly wherein the free ends of the shield member that form the inner shield wall are spaced apart from each other.

FIGS. 12–18 illustrate other applications of principles of the present invention with respect to alternate forms and constructions which the inner shield wall 145 may take. In FIG. 12, the inner shield wall 145 is continuous in its extent (or depth) within the connector receptacle. In FIG. 13, the two free ends 146 of the inner shield wall 145 are spaced apart and separated by an intervening gap 160. This gap 160 will fill with air, insulator, plastic or whatever material the component housing 102 is molded from. The separation of the two free ends 146 does not significantly adversely affect the electrical affinity of the innermost terminals 106*a*, 106*b* to the inner shield wall 145 as each outer terminal runs alongside a free end 146 of the shield wall 145.

Figure 15:
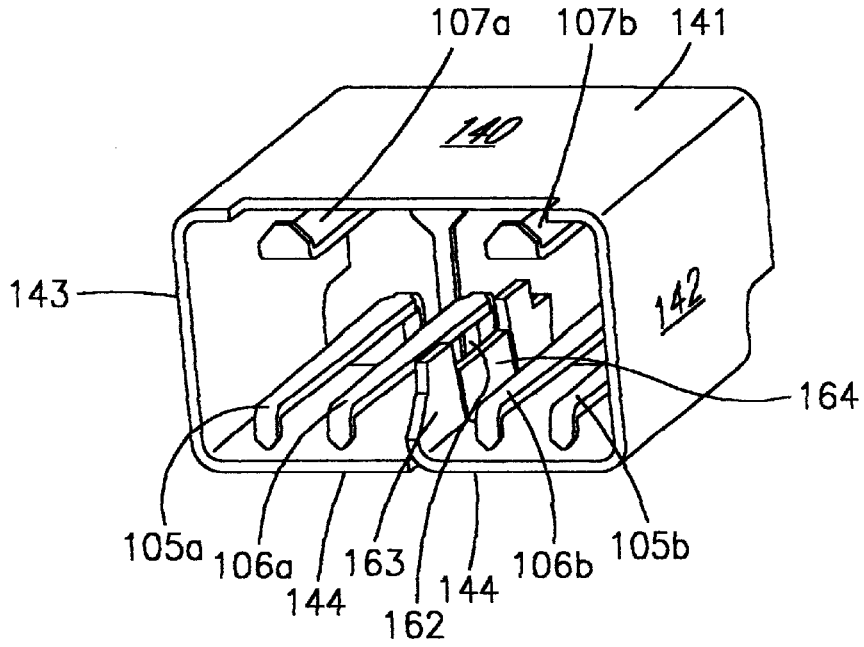
FIG. 15 is a perspective view of yet another embodiment of a grounding shield-terminal assembly of the invention wherein the inner shield wall is formed by interweaving the free ends of the shield.

In FIG. 14, a discontinuous inner shield wall 145 is shown with a central gap 153 disposed between the front and rear edges of the shield wall 145. In FIG. 15, a single thickness inner shield wall 145 is illustrated (as well as in FIG. 17). This shield wall of FIG. 15 is formed by stamping a slot 162 in one of the free ends of one shell 140 between two posts 163 and forming a comparable sized post 164 that is received within the slot 162.

Figure 16:
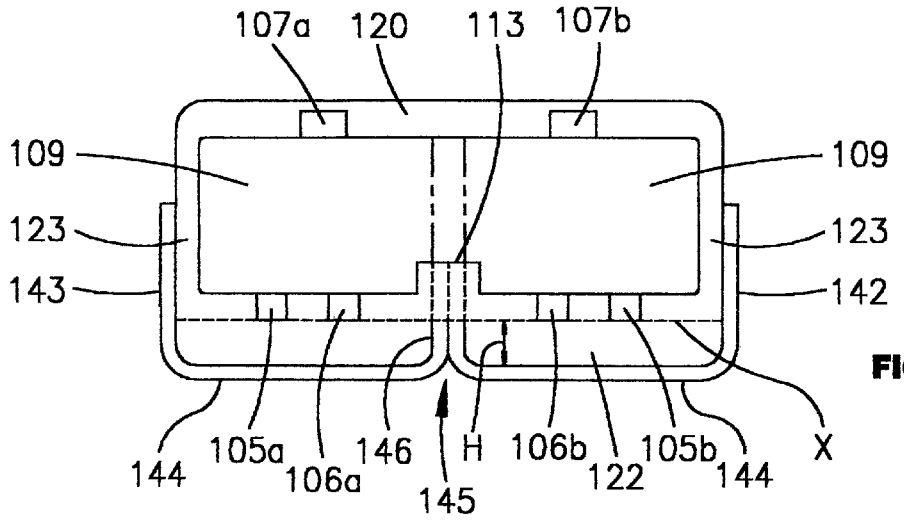
FIG. 16 is a front end view of another embodiment of a connector constructed in accordance with the principles of the present invention and wherein the external grounding shield extends along only three sides of the connector housing.
Figure 17:
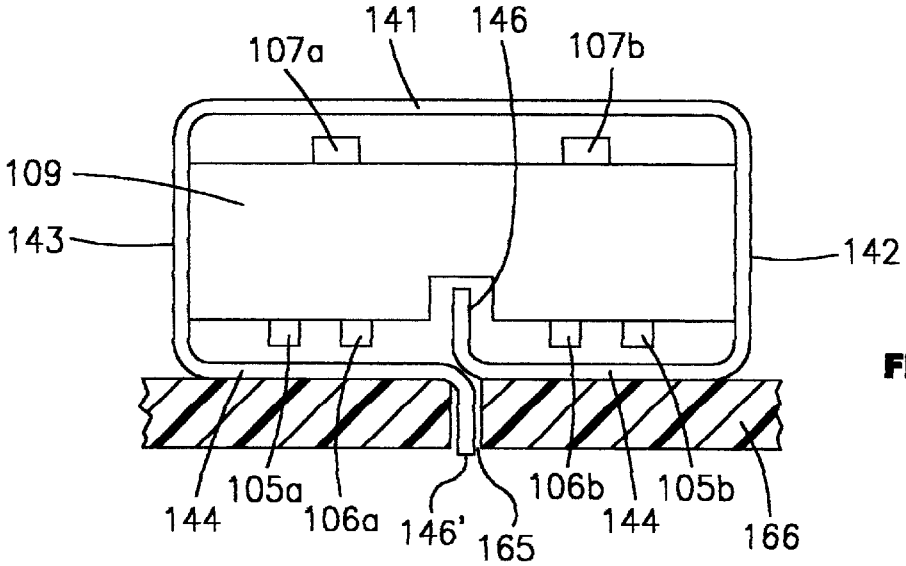
FIG. 17 is a front end view of another embodiment of a connector of the present invention utilizing a single thickness as an inner shield wall with a portion of the shield providing an end for connecting to a ground circuit of a circuit board; and, FIG. 18 is a perspective view of another manner of constructing the shield member.

FIG. 16 illustrates the use of a partial grounding shield that extends on at least three of the four exterior surfaces of the connector housing 102. FIG. 17 illustrates another execution of a single thickness inner shield wall wherein one of the free ends 146 is bent up and enters the connector receptacle 109. However, in this embodiment the other free end 146' is bent outwardly and at least a portion of it serves as a contact that may be received within through hole 165 in a circuit board 166 for direct connection to a ground circuit. This manner of execution permits the elimination of the ground tabs 132, if desired.

Figure 11A:
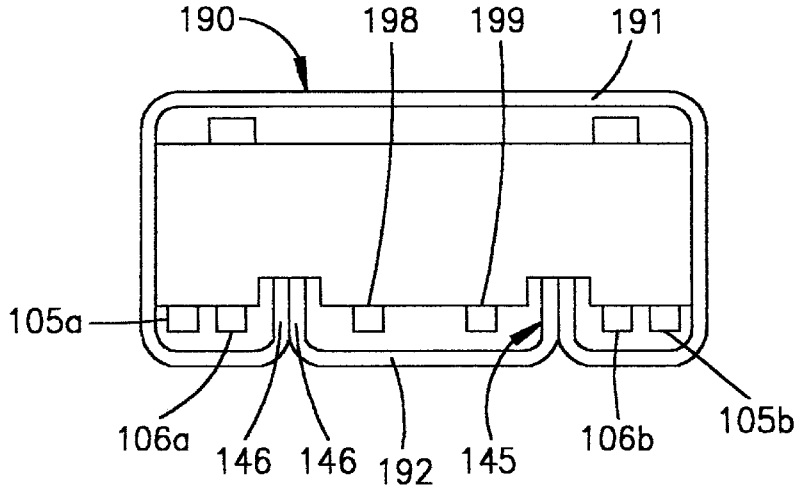
FIG. 11A is a front end view of an alternate embodiment of a connector of the present invention in which a two-component grounding shield is used to provide signal isolation.
Figure 11B:
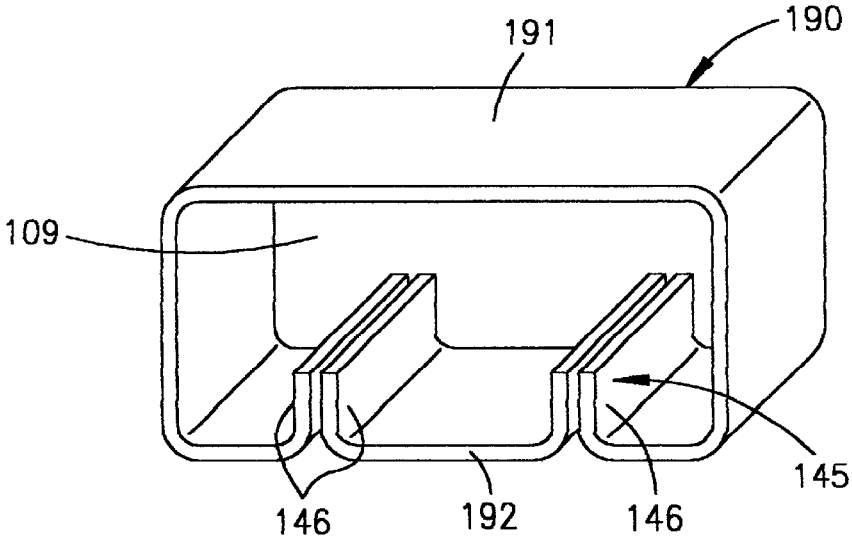
FIG. 11B is a perspective view of the two-component grounding shield used in the connector of FIG. 11A, illustrating the relationship between the two grounding shield components.
Figure 18:
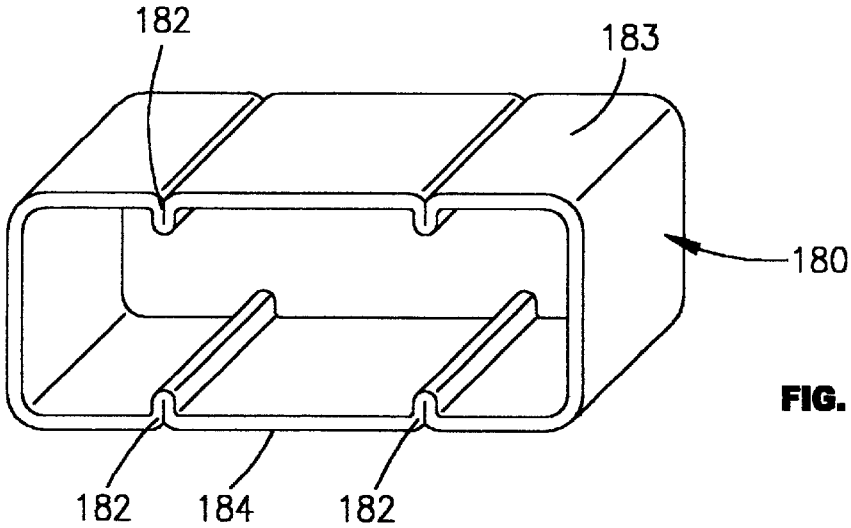

Lastly, FIGS. 11A and B and 18 illustrate grounding shields 180, 190 with multiple inner shield walls. In FIGS. 11A and B, the shield 190 is formed from two parts: an outer cover 191 and an insert shield member 192. Each of the parts has free ends 146 that extend out of the exterior plane of the shield member either into or toward the connector receptacle 109. These free ends 146 may be combined as shown in the other figures to form multiple inner shield wall 145, with two such walls being shown in FIG. 11A. In this execution, both the innermost terminals 106*a*, 106*b* and the interior terminals 198, 199 are positioned to derive capacitive coupling from the inner shield walls 145. FIG. 18 illustrates a similar concept but shows multiple inner shield walls 182 that are formed along the top and bottom walls 183, 184 of the shield 180. These walls 102 are made in an accordion fashion, meaning the shell 181 is pleated or folded upon itself, while one of the inner walls 145 may be formed from two free ends 146 in the manner previously described.

While the preferred embodiment of the invention have been shown and described, it will be apparent to those skilled in the art that changes and modifications may be made therein without departing from the spirit of the invention, the scope of which is defined by the appended claims.

We claim:

1. A multiple channel connector having reduced electrical interference between the channels of the connector, comprising:

an insulative connector body defining a receptacle for an opposing plug connector, the insulative connector body supporting a plurality of conductive terminals, at least pairs of said terminals being associated with single channels of said connector, said insulative connector body having a first wall portion that extends widthwise of said insulative connector body, at least first and second pairs of said terminals being disposed on the connector body first wall and spaced apart lengthwise of said insulative connector body, said first pair of terminals forming at least a part of a first channel of said connector, said second pair of terminals forming at least a part of a second channel of said connector; and, a conductive shield member, the shield member including a shell having two free ends, said shell at least partially extending around insulative connector body in a fashion such that said shell free ends abut each other, at least one of said shell free ends extending within said insulative connector body and toward said connector body receptacle between said first and second pairs of terminals to define an inner shielding wall of said connector body receptacle, the inner shielding wall reducing interference between adjoining terminals of said first and second pairs of terminals.

2. The connector of claim 1, wherein both of said shell free ends extend into said connector body receptacle between said first and second pairs terminals.

3. The connector of claim 1, wherein said signal terminals have bottom portions that lie in a common plane, and both of said shell free ends extend within said insulative connector body at least to said common plane.

4. The connector of claim 1, wherein said shell forms a shield top wall, two shield sidewalls and two shield bottom walls that cooperatively encircle said insulative connector body and both of said shell free ends extend up from said shield two bottom walls into said connector body receptacle.

5. The connector of claim 4, wherein said two shield bottom walls lie in a common plane.

6. The connector of claim 4, wherein said shell is formed from a unitary blank of a conductive material.

7. The connector of claim 4, wherein said inner shield wall is at least partially enclosed within a portion of said insulative connector body.

8. The connector of claim 4, wherein said insulative connector body includes a key for aligning said opposing plug connector with said connector body receptacle and said inner shield wall is disposed within said key.

9. The connector of claim 1, wherein said inner shield wall is at least partially enclosed within a portion of said insulative connector body.

10. The connector of claim 1, wherein said insulative connector body include a key for aligning said opposing plug connector with said connector body receptacle and said inner shield wall is disposed within said key.

11. The connector of claim 1, wherein said insulative connector body includes a key for aligning an opposing plug connector with said connector body receptacle, said key being disposed in said insulative connector body between said first and second pairs of terminals, said inner shield wall being at least partially enclosed within a portion of said key.

12. The connector of claim 1, wherein said insulative connector body is molded in place within said shell from an electrically insulative material, and said inner shield wall is at least partially encapsulated by said insulative material.

13. The connector of claim 12, wherein said inner shield wall is formed from both of said shell free ends, said shell free ends abutting each other as they extend into said connector body receptacle, both of said shell free ends being at least partially encapsulated by said insulative material.

14. The connector of claim 13, wherein said shell free ends include bearing surfaces for holding said shell in place during molding of said insulative connector body therewith.

15. The connector of claim 1, wherein said connector body receptacle has a given depth and said inner shielding wall extends for substantially the entire depth of said connector receptacle.

16. The connector of claim 1, wherein said inner shielding wall is continuous in its extent into said connector body receptacle.

17. The connector of claim 1, wherein said insulative connector body includes a second wall spaced apart from said first wall, said connector body receptacle being interposed between said connector body first and second walls, said connector including first and second ground terminals respectively associated with said first and second pairs of terminals, said first and second pairs of terminals being disposed along said connector body first wall and said first and second ground terminals being disposed along said connector body second wall.

18. The connector of claim 1, wherein each of said first and second pairs of terminals include sets of differential signal terminals.

19. The connector of claim 1, wherein said shell free ends are spaced equal distances from innermost terminals of said first and second pairs of terminals.

20. The connector of claim 19, wherein said shell includes a pair of vertical sidewalls extending along exterior surfaces of said insulative connector body, and said shell vertical sidewalls are spaced equal distances from outermost terminals of said first and second pairs of terminals.

21. A shielded receptacle connector for mating with an opposing plug connector, the connector comprising:

a connector body molded from an electrically insulative material, the housing defining a receptacle for the opposing plug connector, the connector body supporting a plurality of conductive terminals, said terminals including at least first and second pairs of signal terminals defining in part, respective first and second signal channels of said connector, said connector body having first and second support walls extending forwardly therefrom, said first and second pairs of signal terminals being disposed widthwise on said connector body first wall in spaced apart order, said first and second pairs of signal terminals further being disposed on opposite sides of an imaginary datum line that bisects said connector, said imaginary datum line dividing each of said first and second pairs of signal terminals into first and second outermost and innermost signal terminals; and, a conductive shield member formed from a metal blank with a predetermined thickness and having first and second free ends, the shield member extending around said connector body first and second walls to form an exterior shielding wall of said predetermined thickness that substantially encircles said connector receptacle, said shield member having at least two sidewalls and two bottom walls, said sidewalls extending in different planes than said bottom walls so as to define two exterior corners of said shield member disposed on the exterior of said connector housing, said first and second free ends abutting each other and extending into said connector body receptacle to form an interior shielding wall disposed within said connector housing, said two free ends extending in different planes than said shield member bottom walls so as to define two interior corners of said shield member that are disposed within said connector housing, said interior shielding wall extending into said connector body receptacle at said connector body first wall between said first and second pairs of signal terminals.

22. The connector of claim 21, wherein said imaginary datum line substantially coincides with a centerline of said connector and said interior shielding wall is partially encapsulated by said insulative molding material.

23. The connector of claim 22, wherein said connector body includes a key member extending from said connector body first wall and said interior shielding wall is embedded in said key.

24. The connector of claim 21, wherein said interior shielding wall is disposed within said connector receptacle between said first and second pairs of signal terminals such that said shield member first free end is spaced from said first signal terminal pair innermost terminal approximately a same distance as said shield member first sidewall is spaced from said first signal terminal pair outermost terminal, and said shield member second free end is spaced from said second signal terminal pair innermost terminal approximately a same distance as said shield member second sidewall is paced from said second signal terminal pair outermost terminal.

25. The connector of claim 21, further including first and second ground terminals respectively associated with said first and second pairs of signal terminals, said first and second ground terminals being disposed on said connector body second wall.

26. A shielded connector for use in multiple signal channel systems having improved isolation between adjoining signal channels, comprising:

a housing supporting at least first and second sets of signal terminals, each set of signal terminals defining a distinct signal channel of said connector, each set of signal terminal further including respective first and second signal terminals, said terminals being supported in said housing in spaced apart order widthwise along said connector, a metal shield extending on at least three distinct exterior surfaces of said housing in at least three distinct planes, the metal shield having at least one free end that extends in a fourth plane into a portion of said housing, the metal shield free end being interposed between said first and second sets of terminals such that said metal shield free end is flanked on opposite sides thereof by said second terminals of said first and second sets of signal terminals.

27. The connector of claim 26, wherein said shield includes a second free end, the second free end extending away from said connector housing to provide a projecting member whereby said shield may be connected to a circuit on a circuit board.

28. The connector of claim 26, wherein said metal shield free end is encapsulated within a portion of said connector housing.

29. The connector of claim 26, further including first and second ground terminals supported by said connector housing in a spaced-apart relationship from said first and second sets of signal terminals, said first ground terminal being associated with said first set of signal terminals and said second ground terminal being associated with said second set of signal terminals.

30. A multiple channel connector with improved electrical performance, comprising:

an insulative connector body defining a receptacle for an opposing plug connector, the connector body supporting a plurality of conductive terminals, at least pairs of said terminals being associated with single channels of said connector, said connector body having a first wall portion that extends widthwise of said connector body, at least first and second sets of said terminals being disposed on the connector body first wall and spaced apart lengthwise of said connector body, said first set of terminals forming at least a part of a first signal channel of said connector and said second set of terminals forming at least a part of a second signal channel of said connector; and, a conductive shield member, the shield member including a shell having two free ends, said shell extending around the connector body so that said shell free ends abut each other and further extend into said connector housing and toward said connector body receptacle between said first and second sets of terminals to define an inner shielding wall of said connector receptacle, the inner shielding wall being at least partially interposed between said first and second sets of terminals such that outermost terminals of said first and second terminal sets extend alongside two walls of said shield member and innermost terminals of said first and second terminal sets extend alongside said inner shielding wall.

31. A shielded receptacle connector for mating with an opposing plug connector, the connector comprising:

a connector body molded from an electrically insulative material, the housing defining a receptacle for the opposing plug connector, the connector body supporting a plurality of conductive terminals, said terminals including at least first and second pairs of signal terminals defining in part, respective first and second signal channels of said connector, said connector body having first and second support walls extending forwardly therefrom, said first and second pairs of signal terminals being disposed widthwise on said connector body first wall in spaced apart order, said first and second pairs of signal terminals further being disposed on opposite sides of an imaginary datum line that bisects said connector, said imaginary datum line dividing each of said first and second pairs of signal terminals into first and second outermost and innermost signal terminals; and, a conductive shield member formed from a metal blank with a predetermined thickness and having first and second free ends, the shield member extending around said connector body first and second walls to form an exterior shielding wall of said predetermined thickness that substantially encircles said connector receptacle, said shield member having at least two sidewalls and two bottom walls, said sidewalls extending in different planes than said bottom walls so as to define two exterior corners of said shield member disposed on the exterior of said connector housing, said first and second free ends abutting each other and extending into said connector body receptacle to form an interior shielding wall disposed within said connector housing, said two free ends extending in different planes than said shield member bottom walls so as to define two interior corners of said shield member that are disposed within said connector housing, portions of said interior shielding wall being disposed within said connector receptacle between said first and second pairs of signal terminals such that said shield member first free end is spaced from said first signal terminal pair innermost terminal approximately a same distance as said shield member first sidewall is spaced from said first signal terminal pair outermost terminal, and said shield member second free end is spaced from said second signal terminal pair innermost terminal approximately a same distance as said shield member second sidewall is spaced from said second signal terminal pair outermost terminal.

32. A shielded receptacle connector for mating with an opposing plug connector, the connector comprising:

a connector body molded from an electrically insulative material, the housing defining a receptacle for the opposing plug connector, the connector body supporting a plurality of conductive terminals, said terminals including at least first and second pairs of signal terminals defining in part, respective first and second signal channels of said connector, said connector body having first and second support walls extending forwardly therefrom, said first and second pairs of signal terminals being disposed widthwise on said connector body first wall in spaced apart order, said first and second pairs of signal terminals further being disposed on opposite sides of an imaginary datum line that bisects said connector, said imaginary datum line dividing each of said first and second pairs of signal terminals into first and second outermost and innermost signal terminals; and, a conductive shield member formed from a metal blank with a predetermined thickness and having first and second free ends, the shield member extending around said connector body first and second walls to form an exterior shielding wall of said predetermined thickness that substantially encircles said connector receptacle, said shield member having at least two sidewalls and two bottom walls, said sidewalls extending in different planes than said bottom walls so as to define two exterior corners of said shield member disposed on the exterior of said connector housing, said first and second free ends abutting each other and extending into said connector body receptacle to form an interior shielding wall disposed within said connector housing, said two free ends extending in different planes than said shield member bottom walls so as to define two interior corners of said shield member that are disposed within said connector housing, said free ends of said interior shielding wall which extend into said connector body receptacle being partially encapsulated by said insulative molding material.

33. A shielded connector for use in multiple signal channel systems having improved isolation between adjoining signal channels, comprising:

a housing supporting at least first and second sets of signal terminals, each set of signal terminals defining a distinct signal channel of said connector, each set of signal terminal further including respective first and second signal terminals, said terminals being supported in said housing in spaced apart order along said connector housing, a metal shield at least partially extending on exterior surfaces of said housing, the metal shield having at least one projection disposed thereon that extends into a portion of said housing, the metal shield projection being interposed between said first and second sets of terminals such that said metal shield projection is flanked on opposite sides thereof by said first and second sets of signal terminals.

34. The multiple channel connector of claim 33, wherein said shield member is formed from a single piece of metal, and said projections at integrally formed therewith.

35. The multiple channel connector of claim 33, wherein said shield member is formed from at least two parts.

36. A connector having reduced electrical interference between conductive terminals of the connector, comprising:

an insulative connector body defining a receptacle for an opposing plug connector, the insulative connector body supporting a plurality of conductive terminals, at least one pair of said terminals forming a first channel of said connector; and, a conductive shield member, the shield member including a shell having at least one free end, said shell at least partially extending around insulative connector body and said shell one free end extending within said insulative connector body and toward said connector body receptacle between said first channel terminals and the remaining terminals of said plurality of terminals to define an inner shielding wall of said connector body receptacle, the inner shielding wall reducing interference between said first channel terminals and said remaining terminals.

37. A connector having reduced electrical interference between conductive terminals of the connector, comprising:

an insulative connector body defining a receptacle for an opposing plug connector, the insulative connector body supporting a plurality of conductive terminals; and, a conductive shield member that at least partially extends around said insulative connector body, the shield member having at least one free end that extends within said insulative connector body and toward said connector body receptacle between at least one of said terminals and the remaining terminals of said plurality of terminals, the shield member free end defining an inner shielding wall of said connector body receptacle, the inner shielding wall reducing interference between said one terminal and said remaining terminals.

* * * * *